United States Patent [19]

Schold

[11] Patent Number: 4,863,305

[45] Date of Patent: Sep. 5, 1989

[54] ORTHOGONAL CONSTRUCTION JOINT

[76] Inventor: John A. Schold, 4076 Crystal Springs Dr., Bainbridge Island, Wash. 98110

[21] Appl. No.: 299,891

[22] Filed: Jan. 23, 1989

Related U.S. Application Data

[63] Continuation of Ser. No. 109,903, Oct. 19, 1987, abandoned.

[51] Int. Cl.[4] ..... F16D 1/00

[52] U.S. Cl. ..... 403/171; 403/176; 52/285

[58] Field of Search ..... 403/382, 219, 217, 403, 403/173, 171, 176, 177; 52/285, 721

[56] References Cited

U.S. PATENT DOCUMENTS 674,752 5/1901 Baker .
691,049 1/1902 D'Espine .
1,000,395 8/1911 Frost .
3,603,053 9/1971 Van Logheim .
3,788,024 1/1974 De Hartog .
3,798,860 3/1974 Mason ..... 52/285
4,142,342 3/1979 Jungers et al. .
4,409,763 10/1983 Rydeen .

FOREIGN PATENT DOCUMENTS 2036235 6/1980 United Kingdom ..... 403/171

*Primary Examiner*—Andrew V. Kundrat
*Attorney, Agent, or Firm*—Graybeal, Jensen & Puntigam

[57] ABSTRACT

The joint uses a cruciform connector and machine bolts to interconnect two or more beams, and one or two posts, in such a way that the connector is concealed, and the beams as well as either post, may be removed from the joint at a later time, if desired, or added to the joint at such time, if not all of the quadrants of the connector were used initially.

33 Claims, 3 Drawing Sheets

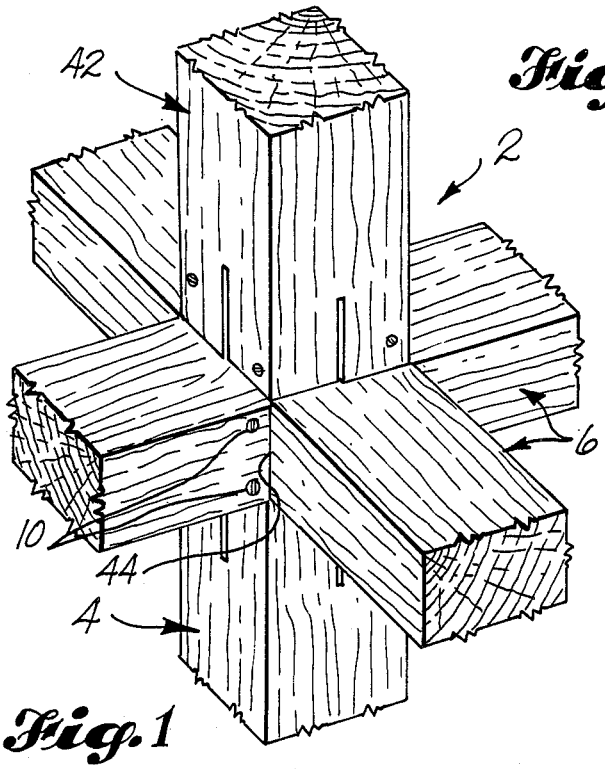
Fig. 1
Fig. 4
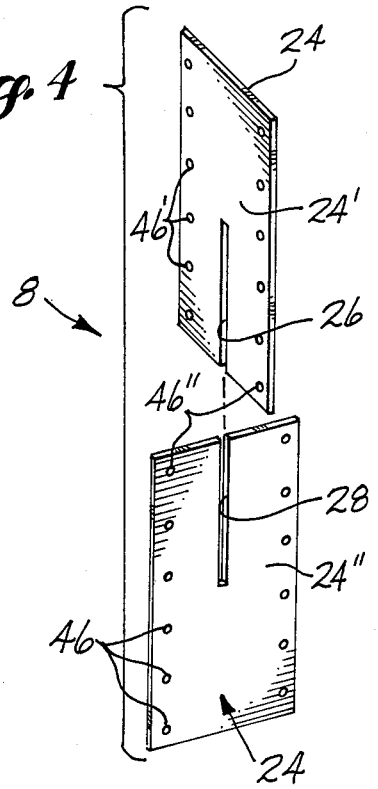
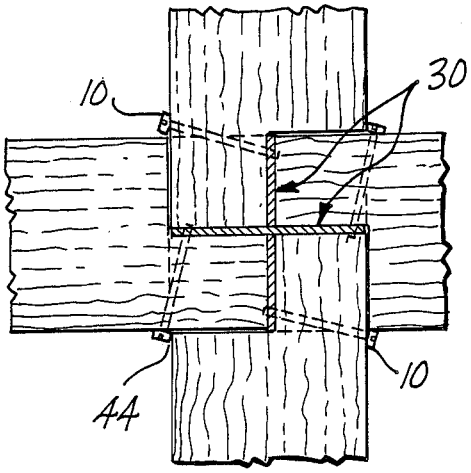
Fig. 3
Fig. 5
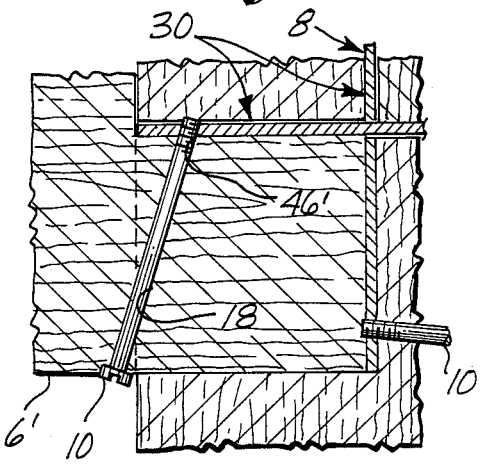

42
50
50
48
24
8
18
18
6'
16
46'
46"
12
14
40
30
30
16
40
12
14
6'
6
18
20
34
48
22
22
4
50
50

ORTHOGONAL CONSTRUCTION JOINT

CROSS REFERENCE TO RELATED APPLICATION

This is a continuation of application Ser. No. 07/109,903 filed Oct. 19, 1987 now abandoned.

DESCRIPTION

1. Technical Field

This invention relates to an orthogonal construction joint in which the connector means are substantially fully concealed within the joint, and in particular, to a joint of this type comprising at least three elongated structural members, the first and second of which are disposed in a common plane, either at an angle to one another, or in line with one another, to be used in a frame, and the third of which is disposed at right angles to the plane of the first and second members, to extend crosswise of the frame. The best example of such a joint is a post and beam joint, but the invention is not limited to such a joint per se.

2. Background Art

Joints of this type have been disclosed in great numbers, but in most of the joints, the three or more members are interconnected with one another in such a way that no one of the members can be subsequently removed from the joint without disassembling the entire joint. This is particularly true where a fourth member, such as another post, is stacked on top of the joint. This follows, in part, moreover, from the fact that the connector means commonly transfer the weight of the respective structural members from one to another in such a way that each is needed to sustain the integrity of the joint, and none can be removed without destroying it.

DISCLOSURE OF THE INVENTION

The present invention provides a means and technique for forming a construction joint of the foregoing type wherein any one or more of the members in the joint can be removed at a later time without affecting the integrity of the joint. Alternatively, more members can be added to the joint, if not all of the sites for the members were filled at the time the original joint was formed.

According to the invention, at least three elongated structural members are arranged together for the joint, and in one version of the same, the first and second members are disposed at an angle to one another in a common plane for use in a frame, and the third is disposed at right angles to the plane of the first and second members, to extend crosswise of the frame. A tenon is formed on one end of the third member, which comprises a pair of angularly offset connector blades that extend axially outwardly from the one end of the third member so as to divide the surface of the same into coplanar abutments, one of which is disposed relatively radially within the angular bight of the blades, and a second of which is disposed relatively radially outside the bight, adjacent one blade thereof. Recesses are formed in the relatively adjacent end portions of the first and second frame members, and the recesses are shaped so as to have pairs of correspondingly angularly offset surfaces thereon. The first and second frame members are interengaged with one another and the tenon on the one end of the third member to form the joint; and in doing so, the pairs of surfaces on the recesses in the end portions of the frame members are relatively inverted to one another in the joint, so that the end portion of one of the frame members engages with the one end of the third member and the tenon at the aforesaid one abutment on the surface of the third member, and the end portion of the other frame member engages with the one end of the third member and the tenon at the second abutment on the surface of the third member, as well as with the side of the one frame member angularly offset from the other blade of the tenon. This produces a closed corner between the first and second frame members, relatively radially within the bight of the blades of the tenon, and to preserve the corner, the first and second frame members are secured to the third member by means including pin-like fastener means which are inserted in the aforesaid joint-forming end portion of the one frame member at a point offset from the corner on the aforesaid angularly offset side of the one frame member, and then engaged with the other blade of the tenon, to secure the one frame member to the third member through the tenon. To render the joint dismantleable, moreover, the fastener means in the presently preferred embodiments of the invention are retractably, detachably engaged with the aforesaid other blade of the tenon, so that they can be removed from the same to free the one frame member for removal from the joint.

In certain of the presently preferred embodiments of the invention, the tenon which is formed on the third member also comprises a second pair of angularly offset connector blades that extend axially outwardly from the one end of the third member in relatively inverted disposition to the first-mentioned pair of blades, so that the two pairs of blades divide the surface of the one end into four coplanar abutments, each of which is disposed relatively radially within one of the angular bights formed by the pairs of blades. This makes it possible for at least one additional similarly end-recessed-and-surfaced elongated frame member to be arranged in the plane of the first and second frame members, and similarly engaged with the one end of the third member and the tenon at one of the additional abutments on the surface of the third member, as well as with the aforesaid side of the adjoining frame member, to produce a closed corner therebetween, relatively radially within the corresponding bight of the blades of the tenon. Moreover, each additional frame member may be secured to the third member by pin-like fastener means which are similarly inserted in the joint-forming end portion of the additional frame member at a point offset from the corresponding corner thereof on the side of the additional frame member angularly offset from the corresponding other blade of the tenon, and then engaged with the other blade to secure the additional frame member to the third member through the tenon.

In some embodiments of the invention, several similarly end-recessed-and-surfaced elongated frame members are arranged in a common plane with one another, perpendicular to the aforesaid third member, and are similarly engaged with the one end of the third member and the tenon at an equal number of abutments on the surface of the third member. Then, at each unused abutment remaining on the surface of the third member, a plug of structural material is retractably, detachably engaged with the one end of the third member and the tenon to produce a joint in which the blades are substantially fully concealed within the joint.

In one group of embodiments, a fourth elongated structural member is arranged in spaced coaxial disposition with the third member, but on the opposite side of the joint therefrom. Tenons are formed on the adjacent ends of the third and fourth members, which comprise back-to-back pairs of angularly offset connector blades that extend axially outwardly from the adjacent ends of the third and fourth members in the space therebetween and in relatively inverted disposition to one another so as to divide the opposing surfaces of the adjacent ends of the third and fourth members into sets of four coplanar abutments apiece, the opposing abutments of which, from set to set, are disposed relatively radially within the angular bights formed by the pairs of blades. Even in such a case, one or more similarly end-recessed-and-surfaced elongated frame members may be arranged in the plane of the first and second frame members and engaged with the tenons and the opposing ends of the third and fourth members at the bights between the pairs of opposing abutments on the surfaces of the third and fourth members. Also, the additional frame member or members may be secured to the third and fourth members in the foregoing manner by inserting pin-like fastener means in the joint-forming end portions of the additional members at points offset from the corners of the same in the joint, and engaging the fastener means with the aforesaid other blades in the joint, to secure the additional frame members to the third and fourth members through the tenons thereof.

Preferably, the pair or pairs of blades are keyed into the end portion of the third member, or the end portions of the third and fourth members, whichever is the case. Where there are two sets of blades and two coaxial structural members, the sets of blades may take the form of a cruciform connector member which is keyed into the end portions of both of the coaxial structural members to project axially therebetween.

In many of the presently preferred embodiments of the invention, the connector member is constructed from a pair of web-like plate members which are correspondingly slotted and interlocked with one another in a cruciform configuration, commonly at the job site itself.

Where the pin-like fastener means are retractably, detachably engaged with a tenon, the presently preferred practice is to form a hole in the aforesaid other blade of the tenon, and to obliquely angle the hole to the same to receive the forward end portion of fastener means which are similarly angularly inserted through the joint-forming end portion of the corresponding frame member. Cooperatively engageable attachment means, such as threading, are then provided on the fastener means and the other blade, at the hole, to enable one to be attached to the other.

For the in-line version of the joint, four elongated structural members are arranged so that the first and second members are disposed in-line with one another for use in a frame, and the third and fourth members are coaxially disposed at right angles to the first and second members, to extend perpendicular to the plane of the frame. Tenons are formed on the adjacent ends of the third and fourth members, which comprise back-to-back pairs of angularly offset connector blades that extend axially outwardly from the adjacent ends of the third and fourth members in the space therebetween, and in relatively inverted disposition to one another so as to divide the opposing surfaces of the adjacent ends of the third and fourth members into sets of four coplanar abutments apiece, the opposing abutments of which, from set to set, are disposed relatively radially within the angular bights formed by the pairs of blades. Recesses are formed in the relatively adjacent end portions of the first and second frame members, and the recesses are shaped so that they have pairs of correspondingly angularly offset surfaces thereon. The first and second frame members are interengaged with the tenons on the adjacent ends of the third and fourth members so that the surfaces on the recesses in the end portions of the frame members are relatively inverted to one another in the joint, the end portion of one of the frame members is engaged with the adjacent ends of the third and fourth members and the tenons at the bight between one pair of opposing abutments on the surfaces of the third and fourth members, and the end portion of the other frame member is engaged with the adjacent ends of the third and fourth members and the tenons at the bight between the pair of opposing abutments on the surfaces of the third and fourth members, diametrically opposed to the aforesaid pair of opposing abutments on the same.

In certain presently preferred embodiments of the invention, structural material is engaged with the adjacent ends of the third and fourth members and the tenons at the remaining bights between the surfaces of the third and fourth members, to produce a joint in which the blades are substantially fully concealed within the joint. And in some of these embodiments, the structural material takes the form of a plug of the same which is retractably, detachably engaged within the joint as indicated.

BRIEF DESCRIPTION OF THE DRAWINGS

These features will be better understood by reference to the accompanying drawings which illustrate a presently preferred embodiment of the joint wherein the aforementioned third member is vertically disposed, and the frame is composed of end-rabbetted frame members which are assembled on top of the third member, either with or without an additional vertical member superposed on the joint thereabove.

In the drawings:

FIG. 1 is a perspective view of this embodiment when two vertical members and four frame members are assembled in the joint;

FIG. 3 is a cross-sectional view of the joint at the bottom of the upper vertical member;

FIG. 4 is a perspective view of the connector member used in assembling the joint;

FIG. 5 is a part cross-sectional view similar to FIG. 3, but illustrating in greater detail the manner in which the respective frame members are fastened to the connector;

BEST MODE FOR CARRYING OUT THE INVENTION

Figure 2:
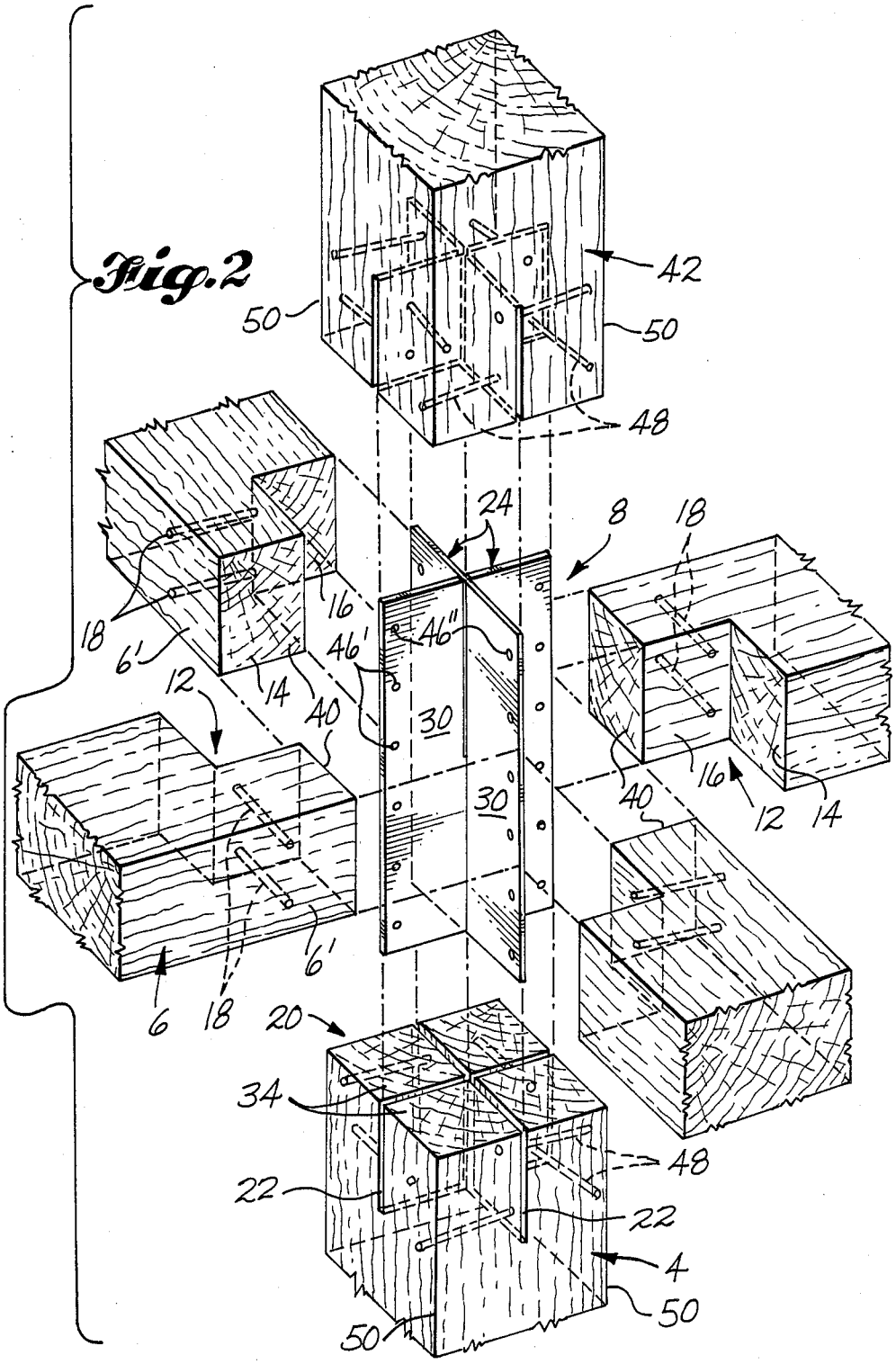
FIG. 2 is an exploded perspective view of the six-member joint of FIG. 1.

Referring to the drawings, it will be seen that both versions of the joint 2 comprise a post 4 and up to four beams 6 that are assembled thereon, using a cruciform connector 8 and a plurality of machine bolts 10 as fasteners for the same. The beams 6 have the same orthogonal cross section and may serve as joists or girders in the frame (not shown) of which they are a part, depending on the structure of the frame otherwise. Each is similarly end-rabbetted at the joint, and the rabbets 12 of the same are uniformly L-shaped so that they have common axially-oriented surfaces 14 and common laterally-oriented surfaces 16 thereon. Moreover, the two surfaces 14 and 16 are of equal width horizontally, and the surfaces 16 are disposed in axial planes of the beams so that the surfaces 14 are half the horizontal width of the same. In addition, the surfaces 16 are all interrupted by pairs of holes 18 which enter the unrabbetted sides 6' of the beams at an oblique angle to the surfaces 16, and at points that are relatively offset from the planes of the surfaces 14 on the opposite side thereof from the surfaces 16. In this way, the holes 18 lend themselves to fastening the beams 6 to the connector 8, as shall be explained.

The top 20 of the post 4 has a pair of deeply inset slots 22 therein, which are disposed in right-angularly related axial planes of the post so as to assume a cruciform configuration. This configuration corresponds to that of the connector 8, which as seen in FIG. 4, comprises a pair of web-like plate members 24 that are correspondingly slotted and interlocked with one another in a curciform configuration. More specifically, the upper plate member 24' has a slot 26 in the bottom edge thereof, at the center of the edge, and the slot 26 extends upwardly to a point midway of the member. The bottom plate member 24'' has a similar slot 28 which is again located at the center of the same, and half the depth of the member, but in the top edge of the member 24'' so that the two members 24' and 24'' can be interlocked with one another as shown. The plate members 24 are sized, moreover, so that the connector 8 can be bayonetted into the cruciform slots 22 of the post 4 at the top 20 of the same, as well as wholly within the slots 22, so as to be flush with the outside surfaces of the post 4. The plate members 24 are also sized so that when they are bayonetted into the slots 22 of the post, portions 30 of the same (FIGS. 3, 5 and 7) remain projecting from the post to form a tenon 32 with which to connect the beams to the post 4. These portions 30 are, of course, orthogonally related, and together define four quadrant-like abutments 34 on the end surface 20 of the post, relatively radially with the angular bights 36 formed by the respective half sections or blades 38 of the portions 30. These half sections or blades 38 correspond in width to that of the surfaces 14 and 16 of the rabbets 12 in the beams 6, and inasmuch as the surfaces 14 and 16 are equal in width, the respective end portions 40 of the beams 6 can be fully rested on the abutments 34 of the post 4 in the manner shown. When the connector 8 is sufficiently long enough, moreover, an additional similarly slotted post 42 (FIGS. 1 through 5) can be rested on the joint 2, preferably after the end portions 40 of the beams 6 are engaged in the spaces between the opposing abutments 34 of the posts 4, 42 defined by the bights 36 of the blades 38. In addition, when the end portions 40 of the beams 6 are so engaged with the connector 8, the surface 14 of each beam will abut up against that surface 6' of the adjoining beam 6 which is angularly offset from the blade 38 abreast of it. Together, then, the two beams 6 form a closed corner 44, relatively radially within the bight 36 of the corresponding blades 38.

In this arrangement, the holes 18 in the beams 6 are offset from the respective corners 44 of the joint 2, so that pin-like fastener means, such as the machine bolts 10, can be inserted in the joint-forming end portions 40 of the beams, and engaged with the connector 8, to secure the beams to the post 4 or posts 4, 42 through the connector 8. Referring again to FIG. 4, it will be seen that the plate members 24 of the connector 8 are equipped with rows of holes 46 that are radially inset from the vertical edges thereof. The sets of holes 46' in he blade-forming center portions 30 of the members 24, are angled to the faces of the members, and along angles corresponding to those of the holes 18 in the beams. Moreover, the holes 46' in the members 24 are threaded and disposed to register with the holes 18 in the beams 6 at the surfaces 16 of the same when the beams are engaged with the connector 8 in the joint. Therefore, the machine bolts 10 can be sized to extend freely through the holes 18 of the beams, and then be threadedly engaged with the holes 46' in the plates 24 of the connector, as seen in FIG. 5. In this way, each beam 6 can be rigidly connected to the post 4 through the connector 8, and yet, if desired, the bolts 10 can be retracted from the holes 46' in the connector, to free the beam for removal from the joint 2. The occasion for this may not occur until long after the joint 2 was made, for example, years later when it is desired to remodel the building or other structure of which the joint is a part.

The remaining holes 46'' in the plates 24 of the connector 8 are also threaded, but are commonly straight-through the plates so that further sets of machine bolts 10 can be engaged with them in predrilled holes 48 formed in the end portions of the post 4, 42, parallel to the outside faces of the same. Alternatively, other means (not shown) may be employed to fasten the posts 4, 42 to the connector 8, and vice-versa, inasmuch as the outer-peripheries of the posts are fully exposed. It is preferred to employ the fastener means adjacent the corners 50 of the posts, however, so that the posts can be accessed at the same time as the beams 6, and from the same corners 44 at which the bolts 10 are inserted in the beams.

Figure 6:
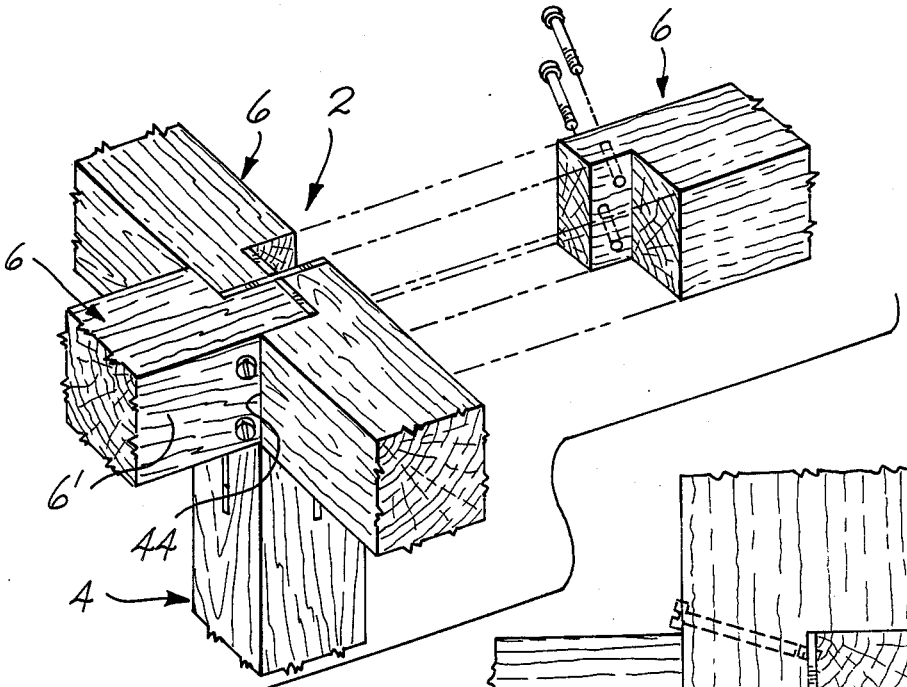
FIG. 6 is a perspective view of the embodiment when a single vertical member is employed, together with up to four frame members, one of which is shown being removed.
Figure 8:
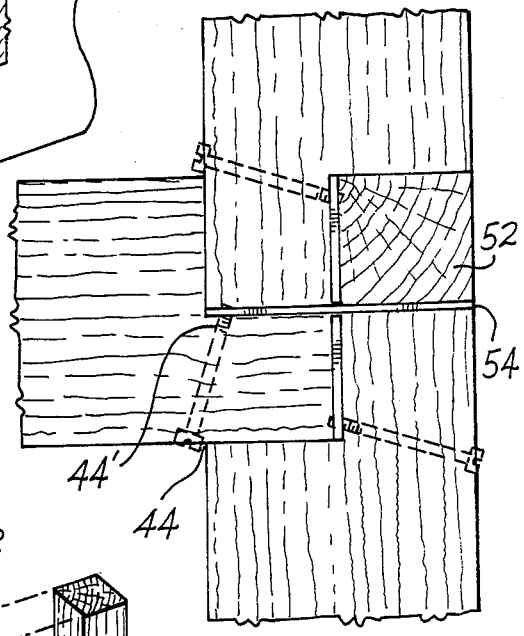
FIG. 8 is a top plan view of the joint after the plug has been inserted in the same.
Figure 7:
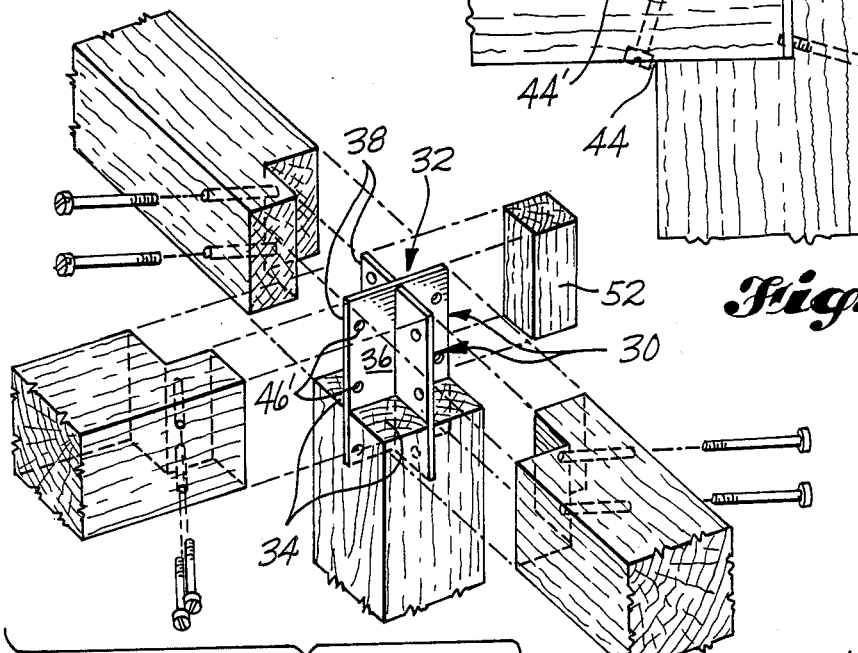
FIG. 7 is a similar view of the five-member joint, after the one frame member has been removed and a plug inserted in its place.

The joint 2 need not employ a full set of beams 6, as was explained earlier; and moreover, the joint need not include a pair of posts 4, 42, as was also explained. Referring now to FIGS. 6 through 8, it will be seen that a beam 6 may be omitted from any quadrant 34 of the joint, and in lieu of it, a plug 52 of similar material may be substituted in the quadrant to conceal all but the adjacent edge 54 of the connector 8 at the post 4 or posts 4, 42. Furthermore, a beam 6 may be removed from the joint, and a plug 52 may be substituted for it, in the manner of FIGS. 6 through 8.

The beams 6 may be square, rectangular or polygonal in cross-section, or conceivably even round. Similarly, the posts 4, 42 may be any of these cross-sections; but in many of the presently preferred embodiments of the invention, the beams and posts are of the same cross-section so that they may be used interchangeably on a job.

The plates 24 of the connector 8 are commonly 3/16" in thickness to accomodate the threaded holes 46 through them. In some embodiments, the end portions 40 of the beams 6 are shortened to leave a slight gap (not shown) for the projecting tips of the bolts 10. Preferably, they should not engage the end portions 40 adjoining the beams.

The plugs 52 may be strapped or otherwise secured to the posts.

I claim:

1. A method of forming an orthogonal construction joint, comprising:

arranging at least three elongated structural members so that the first and second members are disposed at an angle to one another in a common plane for use in a frame, and the third is disposed at right angles to the plane of the first and second members, to extend crosswise of the frame, forming a tenon on one end of the third member, which comprises a pair of angularly offset connector blades that extend axially outwardly from the one end of the third member so as to divide the surface of the same into coplanar abutments, one of which is disposed relatively radially within the angular bight of the blades, and a second of which is disposed relatively radially outside the bight, adjacent one blade thereof, forming recesses in the relatively adjacent end portions of the first and second frame members, and shaping the recesses so that they have pairs of correspondingly angularly offset surfaces thereon, interengaging the first and second frame members with one another and the tenon on the one end of the third member so that the pairs of surfaces on the recesses in the end portions of the frame members are relatively inverted to one another in the joint, the end portion of one of the frame members is engaged with the one end of the third member and the tenon at the aforesaid one abutment on the surface of the third member, and the end portion of the other frame member is engaged with the one end of the third member and the tenon at the second abutment on the surface of the third member, as well as with the side of the one frame member angularly offset from the other blade of the tenon, to produce a closed corner between the first and second frame members, relatively radially within the bight of the blades of the tenon, and securing the first and second frame members to the third member, including inserting pin-like fastener means in the aforesaid joint-forming end portion of the one frame member at a point offset from the corner on the aforesaid angularly offset side of the one frame member, and engaging the fastener means with the other blade of the tenon, to secure the one frame member to the third member through the tenon.

2. The method according to claim 1 wherein the fastener means are retractably, detachably engaged with the aforesaid other blade of the tenon, so that they can be removed from the same to free the one frame member for removal from the joint.

3. The method according to claim 1 wherein the tenon formed on the third member also comprises a second pair of angularly offset connector blades which extend axially outwardly from the one end of the third member in relatively inverted disposition to the first-mentioned pair of blades, so that the two pairs of blades divide the surface of the one end into four coplanar abutments, each of which is disposed relatively radially within one of the angular bights formed by the pairs of blades.

4. The method according to claim 3 wherein at least one additional similarly end-recessed-and-surfaced elongated frame member is arranged in the plane of the first and second frame members, and similarly engaged with the one end of the third member and the tenon at one of the additional abutments on the surface of the third member, as well as with the aforesaid side of the adjoining frame member, to produce a closed corner therebetween, relatively radially within the corresponding bight of the blades of the tenon.

5. The method according to claim 4 wherein each additional frame member is secured to the third member by pin-like fastener means which are similiarly inserted in the joint-forming end portion of the additional frame member at a point offset from the corresponding corner thereof on the side of the additional frame member angularly offset from the corresponding other blade of the tenon, and engaged with the other blade to secure the additional frame member to the third member through the tenon.

6. The method according to claim 3 wherein several similarly end-recessed-and-surfaced elongated frame members are arranged in a common plane with one another, perpendicular to the aforesaid third member, and are similarly engaged with the one end of the third member and the tenon at an equal number of abutments on the surface of the third member, and a plug of structural material is retractably, detachably engaged with the one end of the third member at each unused abutment remaining on the surface of the same, to produce a joint in which the blades are substantially fully concealed within the joint.

7. The method according to claim 1 wherein a fourth elongated structural member is arranged in spaced coaxial disposition with the third member, but on the opposite side of the joint therefrom, and tenons are formed on the adjacent ends of the third and fourth members, which comprise back-to-back pairs of angularly offset connector blades that extend axially outwardly from the adjacent ends of the third and fourth members in the space therebetween and in relatively inverted disposition to one another so as to divide the opposing surfaces of the adjacent ends of the third and fourth members into sets of four coplanar abutments apiece, the opposing abutments of which, from set to set, are disposed relatively radially within the angular bights formed by the pairs of blades.

8. The method according to claim 7 wherein one or more additional similarly end-recessed-and-surfaced elongated frame members are arranged in the plane of the first and second frame members and engaged with the tenons and the opposing ends of the third and fourth members at the bights between pairs of opposing abutments on the surfaces of the third and fourth members, and the additional frame member or members are secured to the third and fourth members by inserting pin-like fastener means in the joint-forming end portions of the additional frame member or members at points offset from the corners of the same in the joint, and engaging the fastener means with the aforesaid other blades in the joint, to secure the additional frame member or members to the third and fourth members through the tenons thereof.

9. The method according to claim 1 wherein the pair of blades is keyed into the end portion of the third member.

10. The method according to claim 7 wherein the pairs of blades are keyed into the end portions of the third and fourth members.

11. The method according to claim 7 wherein the two sets of blades take the form of a cruciform connector member which is keyed into the end portions of the coaxial structural members to project axially therebetween.

12. The method according to claim 11 wherein a pair of web-like plate members are correspondingly slotted and interlocked with one another in a cruciform configuration, to form the connector member.

13. The method according to claim 1 wherein a hole is formed in the aforesaid other blade of the tenon, and the hole is obliquely angled to the other blade to receive the forward end portion of fastener means which are similarly angularly inserted through the joint-forming end portion of the corresponding frame member.

14. The method according to claim 13 wherein the fastener means are attached to the other blade, at the hole, by cooperatively engageable attachment means thereon.

15. A method of forming an orthogonal construction joint, comprising:

arranging four elongated structural members so that the first and second members are disposed in-line with one another for use in a frame, and the third and fourth members are coaxially disposed at right angles to the first and second members, to extend perpendicular to the plane of the frame, forming tenons on the adjacent ends of the third and fourth members, which comprise back-to-back pairs of angularly offset connector blades that extend axially outwardly from the adjacent ends of the third and fourth members in the space therebetween and in relatively inverted disposition to one another so as to divide the opposing surfaces of the adjacent ends of the third and fourth members into sets of four coplanar abutments apiece, the opposing abutments of which, from set to set, are disposed relatively radially within the angular bights formed by the pairs of blades, forming recesses in the relatively adjacent end portions of the first and second frame members, and shaping the recesses so that they have pairs of correspondingly angularly offset surfaces thereon, interengaging the first and second frame members with the tenons on the adjacent ends of the third and fourth members so that the surfaces on the recesses in the end portions of the frame members are relatively inverted to one another in the joint, the end portion of one of the frame members is engaged with the adjacent ends of the third and fourth members and the tenons at the bight between one pair of opposing abutments on the surfaces of the third and fourth members, and the end portion of the other frame member is engaged with the adjacent ends of the third and fourth members and the tenons at the bight between the pair of opposing abutments on the surfaces of the third and fourth members, diametrically opposing to the aforesaid one pair of opposing abutments on the same.

16. The method according to claim 15 wherein structural material is engaged with the adjacent ends of the third and fourth members and the tenons at the remaining bights between the surfaces of the third and fourth members, to produce a joint in which the blades are substantially fully concealed within the joint.

17. The method according to claim 16 wherein the structural material takes the form of a plug of the same which is retractably, detachably engaged within the joint as indicated.

18. An orthogonal construction joint comprising:

at least three elongated structural members, the first and second of which are disposed at right angles to one another in a common plane for use in a frame, and the third of which is disposed at right angles to the plane of the first and second members, to extend crosswise of the frame, there being a tenon formed on one end of the third member, which comprises a pair of angularly offset connector blades that extend axially outwardly from the one end of the third member so as to divide the surface of the same into coplanar abutments, one of which is disposed relatively radially within the angular bight of the blades, and a second of which is disposed relatively radially outside the bight, adjacent one blade thereof, the relatively adjacent end portions of the first and second frame members having recesses formed therein which have pairs of correspondingly angular offset surfaces thereon, whereby the first and second frame members are interengageable with one another and the tenon on the one end of the third member so that the pairs of surfaces on the recesses in the end portions of the frame members are relatively inverted to one another in the joint, the end portion of one of the frame members is engaged with the one end of the third member and the tenon at the aforesaid one abutment on the surface of the third member, and the end portion of the other frame member is engaged with the one end of the third member and the tenon at the second abutment on the surface of the third member, and with the side of the one frame member angularly offset from the other blade of the tenon, to produce a closed corner between the first and second frame members, relatively radially within the bight of the blades of the tenon, and means for securing the first and second frame members to the third member, including pin-like fastener means which are insertable in the aforesaid joint-forming end portion of the one frame member at a point offset from the corner on the aforesaid angularly offset side of the one frame member, and engageable with the other blade of the tenon, to secure the one frame member to the third member through the tenon.

19. The construction joint according to claim 18 wherein the fastener means are retractably, detachably engageable with the tenon, so that they can be removed from the same to free the one frame member for removal from the joint.

20. The construction joint according to claim 18 wherein the tenon also has a second pair of angularly offset connector blades formed thereon that extend axially outwardly from the one end of the third member in relatively inverted disposition to the first-mentioned pair of blades, so that the two pairs of blades divide the surface of the one end into four coplanar abutments, each of which is disposed relatively radially within one of the angular bights formed by the pairs of blades.

21. The construction joint according to claim 20 wherein at least one additional similarly end-recessed-and-surfaced elongated frame member is arranged in the plane of the first and second frame members and similarly engaged with the one end of the third member and the tenon at one of the additional abutments on the surface of the third member, and with the aforesaid side of the adjoining frame member, to produce a closed corner therebetween, relatively radially within the corresponding bight of the blades of the tenon; and each additional frame member is secured to the third member by pin-like fastener means which are similarly inserted in the joint-forming end portion of the additional frame member at a point offset from the corresponding corner thereof on the side of the additional frame member angularly offset from the corresponding other blade of the tenon, and engaged with the other blade to secure the additional frame member to the third member through the tenon.

22. The construction joint according to claim 20 wherein several similarly end-recessed-and-surfaced elongated frame members are arranged in a common plane with one another, perpendicular to the aforesaid third member, and are similarly engaged with the one end of the third member at an equal number of abutments on the surface of the third member, and wherein a plug of structural material is retractably, detachably engaged with the one end of the third member at each unused abutment remaining on the surface of the third member, to produce a joint in which the blades are substantially fully concealed within the joint.

23. The construction joint according to claim 18 wherein a fourth elongated structural member is arranged in spaced coaxial disposition with the third member, but on the opposite side of the joint therefrom, and there are tenons formed on the adjacent ends of the third and fourth members, which comprise back-to-back pairs of angularly offset connector blades that extend axially outwardly from the adjacent ends of the third and fourth members in the space therebetween and in relatively inverted disposition to one another so as to divide the opposing surfaces of the adjacent ends of the third and fourth members into sets of four coplanar abutments apiece, the opposing abutments of which, from set to set, are disposed relatively radially within the angular bights formed by the pairs of blades; and one or more additional similarly end-recessed-and-surfaced elongated frame members are arranged in the plane of the first and second frame members and engaged with the tenons and the opposing ends of the third and fourth members at the bights between pairs of opposing abutments on the surfaces of the ends of the third and fourth members, and the additional frame member or members are secured to the third and fourth members by pin-like fastener means which are inserted in the joint-forming end portions of the additional frame members at points offset from the corners of the same in the joint, and engaged with the aforesaid other blades in the joint, to secure the additional frame member or members to the third and fourth members through the tenons thereof.

24. The construction joint according to claim 18 wherein a fourth elongated structural member is arranged in spaced coaxial disposition with the third member, but on the opposite side of the joint therefrom, and there are tenons formed on the adjacent ends of the third and fourth frame members, which comprise back-to-back pairs of angularly offset connector blades that extend axially outwardly from the adjacent ends of the third and fourth members so as to divide the surfaces of the ends into sets of coplanar abutments, the opposing abutments of which, from set to set, are disposed relatively radially within the angular bights formed by the pairs of blades.

25. The construction joint according to claim 24 wherein the pairs of blades take the form of a cruciform connector member which is keyed into the adjacent end portions of the third and fourth members so as to project axially therebetween.

26. The construction joint according to claim 25 wherein the connector member takes the form of a pair of web-like plate members which are correspondingly slotted and interlocked with one another in a cruciform configuration.

27. The construction joint according to claim 18 wherein the pair of blades is keyed into the one end portion of the third member so as to project therefrom.

28. The construction joint according to claim 18 wherein the other blade has an obliquely angled hole therein receiving the forward end portion of similarly angularly inserted fastener means, and there are cooperatively engageable attachment means on the fastener means and the other blade, at the hole, attaching one to the other.

29. The construction joint according to claim 28 wherein the hole and the fastener means are threadedly engaged with one another.

30. The construction joint according to claim 18 wherein the third member is vertically disposed and the frame is disposed at the top or bottom thereof.

31. An orthogonal construction joint comprising:

four elongated structural members arranged so that the first and second members are disposed in-line with one another for use in a frame, and the third and fourth members are coaxially spaced apart from one another at right angles to the first and second members, to extend perpendicular to the plane of the frame, there being tenons on the adjacent ends of the third and fourth members, which comprise back-to-back pairs of angularly-offset connector blades that extend axially outwardly from the adjacent ends of the third and fourth members in the space therebetween, and in relatively inverted disposition to one another so as to divide the opposing surfaces of the adjacent ends of the third and fourth members into sets of four coplanar abutments apiece, the opposing abutments of which, from set to set, are disposed relatively radially within the angular bights formed by the pairs of blades, and the relatively adjacent end portions of the first and second frame members having recesses formed therein which have pairs of correspondingly angularly off-set surfaces thereon, whereby the first and second frame members are inter-engageable with the tenons on the adjacent ends of the third and fourth members so that the surfaces of the recesses in the end portions of the frame members are relatively inverted to one another in the joint, the end portion of one of the frame members is engageable with the adjacent ends of the third and fourth members and the tenons at the bight between one pair of opposing abutments on the surfaces of the third and fourth members, and the end portion of the other frame member is engageable with the adjacent ends of the third and fourth members and the tenons at the bight between the pair of opposing abutments on the surfaces of the third and fourth members, diametrically opposing to the aforesaid one pair of opposing abutments on the same.

32. The construction joint according to claim 31 wherein structural material is engaged with the adjacent ends of the third and fourth members and the tenons at the remaining bights between the surfaces of the third and fourth members, to produce a joint in which the blades are substantially fully concealed within the joint.

33. The construction joint according to claim 32 wherein the structural material takes the form of a plug of the same which is retractably, detachably engaged within the joint as indicated.

* * * * *